United States Patent [19]

Davenport

[11] 4,069,603

[45] Jan. 24, 1978

[54] BINDING STRIP FOR SHOES

[75] Inventor: Harold F. Davenport, St. Petersburg, Fla.

[73] Assignee: The Alger Corporation, Abington, Mass.

[21] Appl. No.: 740,601

[22] Filed: Nov. 10, 1976

[51] Int. Cl.[2] ..... A43B 23/00

[52] U.S. Cl. ..... 36/57

[58] Field of Search ..... 69/21, 21.5, 9.3, 2, 69/8; 2/338; 36/57

[56] References Cited

U.S. PATENT DOCUMENTS

| | | | |
|---|---|---|---|
| 946,844 | 1/1910 | Keats | 69/21.5 X |
| 1,098,240 | 5/1914 | Fitzgerald | 69/9.3 X |
| 1,241,089 | 9/1917 | Brogan | 12/146 W |
| 2,175,283 | 10/1939 | Cote | 2/338 X |
| 2,912,701 | 11/1959 | Vizard | 69/21 X |
| 3,045,463 | 7/1962 | Hopkins | 69/21 |

*Primary Examiner*—Alfred R. Guest

*Attorney, Agent, or Firm*—Kenway & Jenney

[57] ABSTRACT

There is provided a binding strip for shoes comprising a long strip of leather having marginal portions of substantially uniform thickness and one or more laterally arcuate portions of reduced thickness disposed between the marginal portions; the reduced portion may be passed between rollers which cooperate to crush or break the leather fibers in order to render the binding still more compliant, the result being that the strip may be over-folded about the margin of an element of the shoe upper in such fashion as to provide a smooth wrinkle-free binding of pleasing appearance.

1 Claim, 6 Drawing Figures

FIG. 1
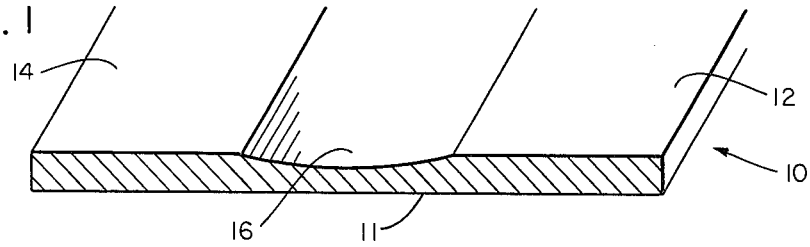
FIG. 2
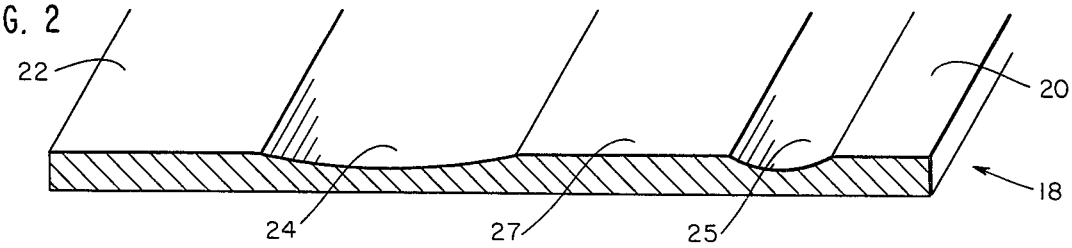
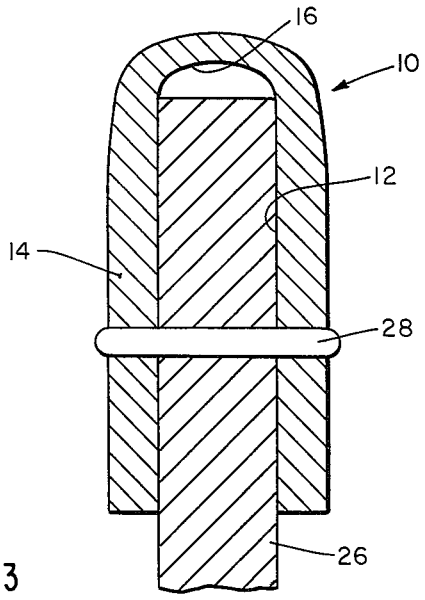
FIG. 3
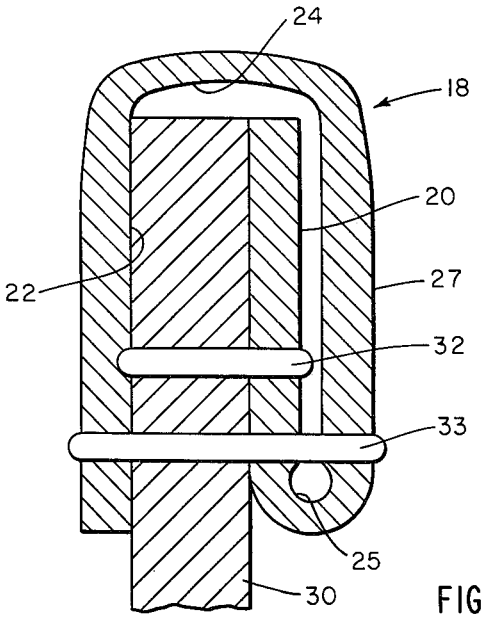
FIG. 4
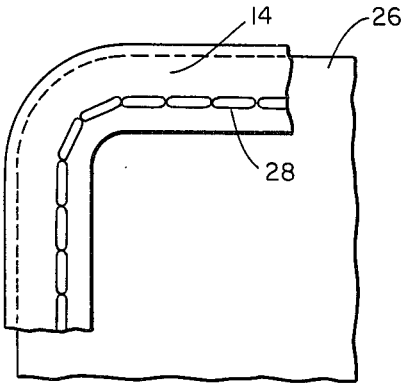
FIG. 5

BINDING STRIP FOR SHOES

BACKGROUND OF THE INVENTION

In the manufacture of shoes of high quality it has long been the custom to apply to an element of a shoe upper, such as a quarter, a strip of leather folded over the upper margin and secured in place by a line or lines of stitching. The binding strip conceals the raw edge of the leather upper and imparts a pleasing finish. However, leather is a difficult material to manipulate, since it is not by any means uniform in its characteristics.

Hitherto it has not been possible to provide a binding strip which can be folded over the margin of an element of a shoe upper and stitched in place without exhibiting relatively unsightly wrinkles. Some improvement was achieved by the process disclosed in U.S. Pat. No. 3,045,463 granted July 24, 1962 to J. D. Hopkins. That patent discloses a method in which the strip is folded to present overlapping marginal portions which are in turn subjected to progressive rolling pressure. This pressure evidently breaks some of the fibers of the leather to render it more pliable than would otherwise be the case. However, although the Hopkins method did constitute an improvement, it was still not possible to produce a binding strip which would be completely free of wrinkles, particularly in areas where the binding strip must turn a corner or follow a curve in the margin of the upper element being bound.

SUMMARY OF THE INVENTION

I have discovered that a markedly improved binding strip can be achieved by providing a long strip of leather of the sort conventionally used for binding strips, and skiving or cutting one or more laterally arcuate grooves running longitudinally along the strip, on the flesh side. Each groove is disposed intermediate marginal portions which have substantially uniform thickness. The location of the grooves laterally across the strip is dependent upon the nature of the type of binding desired. The simplest form is one in which the groove would be substantially centrally located and, the binding strip would simply be folded once in the shape of an inverted "U" embracing the upper margin of an element of the shoe upper. The binding strip would be secured in position by a single line of stitching passing through the marginal portions as well as the element of the shoe upper.

Another system involves first stitching one of the marginal portions to the element of the shoe upper and thereafter folding the binding strip back upon itself, across the top of the element of the upper and down on the other side. The strip is then secured by a second line of stitching running through the over-folded portions of the binding strip, through the element of the shoe upper and then through the other marginal portion of the binding strip.

In the so-called "stitch and turn" system one groove may be disposed off-center so that the reduced portion will, in its final position, be disposed at the apex of the folded strip, overlying the top edge of the element of the upper carrying the binding. A second groove may be formed in the area of the strip which is folded back on itself.

It has been my experience that binding strips fabricated in accordance with my invention not only pass through the folding operations with much greater ease than heretofore, but also result in bindings which are substantially free of wrinkles, even when the binding turns a corner or follows a groove. My invention thus provides an effective solution to a problem which hitherto plagued the industry. I have found that the operation of attaching the binding to an element of a shoe upper is very much easier than heretofore. The binding travels through the folding and stitching devices smoothly, requiring significantly less guidance from the operator.

BRIEF DESCRIPTION OF THE DRAWINGS

FIG. 1 is a view of a binding strip, partly in cross-section and partly in perspective, FIG. 2 is a similar view of a binding strip constructed in accordance with another embodiment of the invention, FIG. 3 is a view in cross-section of a binding strip stitched in place on an element of a shoe upper, and in corporating a strip of the type shown in FIG. 1, FIG. 4 is a view in cross-section of a binding strip stitched to an element of a shoe upper according to the "stitch and turn" method and incorporates a binding strip of the type shown in FIG. 2, FIG. 5 is a view in side elevation of a binding strip stitched in position on an element of a shoe upper, the strip being either of the type shown in FIG. 3 or the type shown in FIG. 4.

DESCRIPTION OF THE PREFERRED EMBODIMENTS

Figure 6:
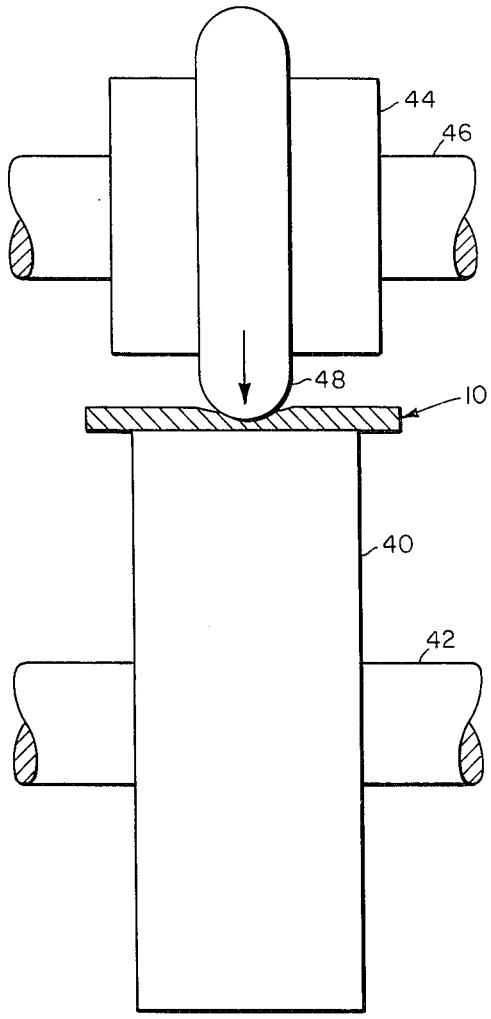
FIG. 6 is a view in cross-section of a pair of rollers operating to compress the fibers of a binding strip.

As shown in FIG. 1 the binding of my invention is formed from a long strip 10 of leather from ¼ inch to 1¼ inch wide and from about 0.028 inch to 0.040 inch thick. The leather is cut so that one surface 11 is a grain surface treated with conventional dressing to form a glossy, smooth, attractive appearance. The opposite surface is the "flesh side " and is unfinished. The strip 10 has marginal areas 12 and 14 which are of uniform thickness, but a continuous laterally arcuate groove 16 is cut into the flesh side. The margainal portions 12 and 14 may be from 0.028 inch to 0.040 inch thick, and the thinnest portion within the groove 16 may be from approximately 0.024 inch to 0.028 inch.

The typical use of the binding 10 is illustrated in FIG. 3 wherein the binding is folded over an element of a shoe upper 26, such, for example, as the upper edges of quarters. The marginal portions 12 and 14 are folded to lie parallel to and against the element 26, and they are secured in position by means of stitching 28 which passes through the marginal portions 12 and 14 as well as through the upper element 26. The result is shown in side elevation at FIG. 5. The groove 16 overlies the upper edge of the element 26. I have found in practice that such a binding is unexpectedly compliant; conforms snuggly to the upper element 26 and is wrinkle-free, even in following curves or corners of the upper element 26, as will be evident from an inspection of FIG. 5.

The location of the groove, or portion of reduced thickness, with respect to the lateral extent of the strip 10 will vary depending upon the desired location of the apex of the binding when it has been over-folded about an element of a shoe upper.

As an example, in FIG. 2 there is shown a strip 18 similar in character to the strip 10 but of greater width. In this embodiment of the invention there are two grooves 24 and 25 and three marginal portions 22, 20 and 27 of uniform thickness. The location of the grooves 24 and 25 is chosen so that, as shown in FIG. 4, exemplifying the "stitch in turn" system, the marginal portion 20 is first stitched to an element of a shoe upper 30, as shown at 32, and then folded back on itself, the groove 24 being located in the area of the fold, and the marginal portion 27 overlies the marginal portion 20. The marginal portion 22 is brought down to overlie the opposite face of the element 30, and the groove 24 lies at the apex of the fold, between the marginal portions 27 and 22. A second line of stitching 33 passes through the marginal portion 22, the element 30, and the marginal portions 20 and 27.

Although binding strips as heretofore described have been used successfully, a still further improvement provides a binding which is exceptionally compliant and useful. This improvement consists in subjecting the grooved portion or portions of a binding strip to the action of a pair of rollers designed to compress and break the leather fibers in the areas of the groove or grooves. To accomplish this end I provide a roller 40 mounted for rotation on a shaft 42 and having a smooth flat periphery. Cooperating with the roller 40 is a roller 44 mounted on a shaft 46 and provided with a narrow bead 48. The shafts 42 and 46 are provided with spring-loaded mounting means capable of adjustment to vary the pressure exerted on a binding strip 10 which is passing between the rollers 40 and 44. The pressure employed will depend upon the thickness and character of the binding strip being treated, and those skilled in the art will very readily determine the pressure required for proper treatment. Of course the binding strip is fitted between the rollers so that the glossy grain surface encounters the smooth flat surface of the roller 40, and the bead 48 presses into the groove which has been formed in the flesh side of the binding strip 10.

I have found that a binding strip of the sort heretofore described not only lends itself to attachment without the formation of wrinkles or irregularities but, because it is exceptionally compliant, travels through the folding and stitching machines so easily that manipulation and guidance by the operator is uniquely minimized. Consequently the operator has a much easier and less fatiguing job than has heretofore been the case.

Having thus described and illustrated preferred embodiments of my invention, what I claim as new and desire to secure by Letters Patent of the U.S. is:

1. A binding strip for shoes, comprising a long strip of leather having a grain side and a flesh side, said flesh side being provided with a continuous laterally arcuate groove cut therein to remove a portion of the fibers therefrom and disposed intermediate the margins of the strip and extending throughout the length of the strip, said cut arcuate groove providing a zone of reduced thickness and facilitating the overfolding of the strip, the fibers of the leather lying beneath said cut arcuate groove being crushed, broken and compressed and the fibers adjacent but beyond said groove being uncrushed so that the strip may be overfolded about the margin of an element of a shoe upper to provide a wrinkle-free binding of pleasing appearance.

* * * * *